US012018498B2

(12) United States Patent
Müller et al.

(10) Patent No.: US 12,018,498 B2
(45) Date of Patent: Jun. 25, 2024

(54) DISTRIBUTION BOOM FOR MOBILE CONCRETE PUMPS COMPRISING JOINTS FOR ADJACENT ARMS, AND MOBILE CONCRETE PUMP

(71) Applicant: Putzmeister Engineering GmbH, Aichtal (DE)

(72) Inventors: Ansgar Müller, Stuttgart (DE); Thomas Greule, Neckartenzlingen (DE)

(73) Assignee: Putzmeister Engineering GmbH, Aichtal (DE)

( * ) Notice: Subject to any disclaimer, the term of this patent is extended or adjusted under 35 U.S.C. 154(b) by 1261 days.

(21) Appl. No.: 16/612,784

(22) PCT Filed: May 9, 2018

(86) PCT No.: PCT/EP2018/062108
§ 371 (c)(1),
(2) Date: Nov. 12, 2019

(87) PCT Pub. No.: WO2018/206702
PCT Pub. Date: Nov. 15, 2018

(65) Prior Publication Data

US 2020/0217093 A1 Jul. 9, 2020

(30) Foreign Application Priority Data

May 12, 2017 (DE) ..... 10 2017 208 032.9

(51) Int. Cl.
*E04G 21/04* (2006.01)

(52) U.S. Cl.
CPC ..... *E04G 21/0436* (2013.01); *E04G 21/0445* (2013.01); *E04G 21/0418* (2013.01); *E04G 2021/049* (2013.01)

(58) Field of Classification Search
CPC ..... E04G 21/0436; E04G 21/0445; E04G 2021/049; E04G 21/0418
See application file for complete search history.

(56) References Cited

U.S. PATENT DOCUMENTS 3,253,677 A * 5/1966 Krynytzky ..... B66F 11/044 182/51
3,685,543 A * 8/1972 Schwing ..... E04G 21/0436 137/351

(Continued)

FOREIGN PATENT DOCUMENTS

CN 202214988 U 5/2012
CN 204098505 U 1/2015

(Continued)

OTHER PUBLICATIONS

"GMB 34—Technical Specification", for Ruhroel GmbH Gelsenkirchen-Horst, F.W. Schwing. GmbH Construction Vehicle Factory, Attachment A2.2, Schwing, , Version 2; Jan. 24, 1992, 64 pgs.

(Continued)

*Primary Examiner* — Matthew W Jellett
*Assistant Examiner* — Christopher D Ballman
(74) *Attorney, Agent, or Firm* — Alix, Yale & Ristas, LLP

(57) ABSTRACT

A distribution boom for a concrete pump comprises at least a first and a second boom arm, wherein the first and the second boom arm are connected to one another via a joint and are pivotable relative to one another via the joint about a pivot axis, and a concrete delivery line is provided along the boom arms. The joint connects the first and the second boom arm offset to one another so that the load-bearing structures of each of the two boom arms intersect a separating plane running perpendicular to the pivot axis between the first and the second boom arm only in the joint, wherein (Continued)

a hydraulic cylinder is arranged on one boom arm and connected to the other boom arm via coupling rods so that the two boom arms can be pivoted relative to one another by the hydraulic cylinder about the pivot axis of the joint.

11 Claims, 8 Drawing Sheets

(56) References Cited

U.S. PATENT DOCUMENTS 4,625,760 A * 12/1986 Mertens ..... E04G 21/0436 285/283
5,045,217 A * 9/1991 Ronan ..... E01H 12/006 210/776
5,640,996 A * 6/1997 Schlecht ..... B66C 13/40 91/361
6,675,822 B1 * 1/2004 Schmitz ..... E04G 21/0427 137/15.09
6,755,259 B2 * 6/2004 Peltola ..... A62C 31/22 239/271
6,808,025 B2 * 10/2004 Bissen ..... A62C 31/24 239/166
7,055,613 B1 * 6/2006 Bissen ..... A62C 31/22 169/68
7,654,286 B2 * 2/2010 Fuegel ..... E04G 21/0436 141/387
9,061,168 B2 * 6/2015 Mikota ..... A62C 31/24
9,376,827 B2 * 6/2016 Hasel ..... E04G 21/0445

FOREIGN PATENT DOCUMENTS

| | | | |
|---|---|---|---|
| CN | 104514375 | A | 4/2015 |
| DE | 202004003077 | U1 | 5/2004 |
| DE | 102013218383 | A1 | 3/2015 |
| DE | 102014203054 | A1 | 9/2015 |
| EP | 0037571 | A2 | 10/1981 |
| EP | 0037571 | B1 | 6/1986 |
| JP | 78730 | Y2 | 3/1995 |
| KR | 20060045623 | A | 5/2006 |

OTHER PUBLICATIONS

International Search Report for International Patent Application No. PCT/EP2018/062108.
Chinese Search Report for Application No. 2018800311878 filed May 9, 2018; Dated: Jan. 12, 2021; 2 pgs.

* cited by examiner

DISTRIBUTION BOOM FOR MOBILE CONCRETE PUMPS COMPRISING JOINTS FOR ADJACENT ARMS, AND MOBILE CONCRETE PUMP

BACKGROUND

The invention relates to a distribution boom for a concrete pump comprising at least two boom arms and to a mobile concrete pump comprising a corresponding distribution boom.

Mobile concrete pumps routinely have a boom arranged on a movable base with a delivery line conducted therealong through which flowable concrete can be pumped. The boom in this case comprises a plurality of boom arms which can each be pivoted relative to one another perpendicular to the longitudinal direction of the boom arms.

This pivoting makes it possible in principle for the boom to be assembled in such a manner that it does not exceed a predefined maximum height when combined with the movable base. The predefined maximum height in this case may correspond to customary road traffic clearances, for example, so that the mobile concrete pump is able to pass under bridges and through tunnels too.

So that the boom can be folded into the smallest size possible and so that the greatest possible maximum number of boom arms can be achieved, it is known in the art for individual boom arms to be cranked. This allows the boom arms to be laid alongside one another in part during fold together about the pivot axes described, so that the bundle of folded boom arms has a smaller height than a corresponding bundle of folded boom arms in which no boom arm is cranked.

For example, in the case of booms for concrete pumps with a total of five RZ-fold boom arms, the third boom arm must have a cranked design such that in the folded state the first two boom arms basically lie alongside the last two boom arms. However, the box-shaped building space required by the boom arms when the boom is in the folded state is not optimally used. In other words, the boom arms in this case take up a substantially greater volume than would result from the total volume of the individual boom arms.

SUMMARY OF THE INVENTION

The problem addressed by the present invention is that of creating a distribution boom for a concrete pump and a mobile concrete pump which is improved by comparison with the prior art.

This problem is solved by a distribution boom in accordance with the main claim and a mobile concrete pump in accordance with the dependent claim 12. Advantageous developments are the subject matter of the dependent claims.

Consequently, the invention relates to a distribution boom for a concrete pump comprising at least a first and a second boom arm, wherein the first and the second boom arm are connected to one another via a joint and are pivotable relative to one another via the joint about a pivot axis, wherein a concrete delivery line is provided along the boom arms, and wherein the joint connects the first and the second boom arm in a manner offset to one another in the axial direction of the pivot axis in such a manner that the load-bearing structures of each of the two boom arms intersect a separating plane running perpendicular to the pivot axis between the first and the second boom arms only in the joint, wherein a hydraulic cylinder is arranged on one boom arm, said hydraulic cylinder being connected to the other boom arm via one or more coupling rods in such a manner that a relative pivoting movement of the two boom arms relative to one another about the pivot axis of the joint can be effected by the hydraulic cylinder.

The invention further relates to a mobile concrete pump having a distribution boom according to the invention.

A few terms used in conjunction with the invention are explained to begin with.

The "load-bearing structure" of a boom arm refers to that part of the structure of a boom arm that substantially receives the loads acting on the boom arm during correct use of the distribution boom. The load-bearing structure of a boom arm is usually configured as a hollow profile. The load-bearing structure of a boom arm does not include, in particular, attachments or extensions of the load-bearing structure which receive no forces, or only negligible forces, when there are loads acting on the boom arm. A concrete delivery line conducted along a boom arm may run at least sectionally on the outside of the boom arm and/or in the inside thereof.

Since it is provided according to the invention that the load-bearing structures of the first and second boom arm only intersect the separating plane running between them in the joint connecting them (in other words, the load-bearing arms do not intersect this separating plane away from the joint), the load-bearing structures of the two boom arms cannot impede one another. Consequently, on account of the load-bearing structures of the boom arms themselves, there is no restriction in terms of the relative pivoting movement relative to one another. In principle, however, existing restrictions on the pivoting movement result instead from the joint or the kinematic chain for triggering the pivoting movement. As the kinematic chain for pivoting the boom arms relative to one another, a hydraulic cylinder is arranged on one of the boom arms in this case which is connected to the other boom arm and/or the lateral projection via one or more coupling rods in such a manner that a relative pivoting movement of the two boom arms relative to one another can be effected by the hydraulic cylinder about the pivot axis of the joint. It is also possible, of course, for the hydraulic cylinder to be supported by a second hydraulic cylinder arranged parallel thereto, wherein the two hydraulic cylinders may each be of smaller dimensions compared with a single hydraulic cylinder with comparable lifting force.

The parts of the boom arm which do not belong to the load-bearing structure may be configured or arranged in such a manner that, although they intersect the separating plane, they do not however impose any (additional) restriction on the pivoting movement. It is of course also possible, however, for the two boom arms as a whole—in other words, not only their load-bearing structures—not to intersect a separating plane running between the first and the second boom arm perpendicular to the pivot axis away from the joint.

When the distribution boom is in the folded state, the load-bearing structures of each of the two boom arms alongside one another lie in the horizontal direction due to the separating plane previously described, but they can easily be arranged overlapping in the vertical direction. In particular, compared with the prior art of a boom with a cranked boom arm, a distribution boom according to the invention can thereby be folded in a more compact manner. Starting from a comparable boom with a cranked boom arm, the installation space required for the folded state can therefore be reduced while the total length remains the same with a distribution boom according to the invention. Alternatively, it is possible for an additional boom arm to be able to be provided with the same installation space with the distribution boom according to the invention, as a result of which the total length of the distribution boom can be increased compared with a comparable boom with a cranked boom arm according to the prior art.

In the case of the distribution boom according to the invention, cranking of a boom arm which is customary in the prior art can be completely dispensed with. Consequently, since particular torsional loads caused by cranking cannot be expected with any of the boom arms of the distribution boom according to the invention, all boom arms can be designed for the bending loads primarily acting on them. By comparison with a cranked boom arm, the load-bearing structure of an uncranked boom arm with a comparable stiffness and load-bearing capacity may be configured with a smaller cross section and therefore a lighter design.

It is possible in principle for the two boom arms to be connected to one another pivotably by a joint pin extending through both boom arms. It is preferable, however, for the joint to have a lateral projection arranged on the second boom arm, which lateral projection protrudes beyond the first boom arm, and the two boom arms are connected to one another pivotably via this lateral projection. The lateral projection therefore protrudes as part of the joint beyond the separating plane between the two boom arms, while the load-bearing structures of each of the boom arms furthermore only intersect the separating plane in the joint. The final connection between the two boom arms or between the first boom arm and the projection of the second boom arm may be similarly configured to the prior art, wherein the boom arms lie in a common plane perpendicular to the pivot axis in the region of the joint. Since, by comparison with a joint pin extending through both boom arms, in the variant with a projection on the second boom arm the joint pin, in particular, can be shorter and has to absorb smaller loads, the embodiment of the joint comprising a projection on the second boom arm usually has a weight advantage.

It is preferable for the joint to have at least one hollow joint pin arranged axially to the pivot axis for carrying fresh concrete from a concrete delivery line on the first boom arm to a concrete delivery line on the second boom arm. Because the fresh concrete is conveyed directly along the pivot axis, an elaborate coupling or flexible hose line for conveying fresh concrete between the concrete delivery lines of the two boom arms which is unfavorable to the pumping of concrete can be dispensed with.

More preferably, the joint comprises two joint pins arranged axially along the pivot axis. If two joint pins—or in other words, a split joint pin—are provided, it is sufficient for only the joint pin located closer to the separating plane to be a hollow joint pin. The other joint pin, on the other hand, need not necessarily be hollow. In this case, the conveyance of fresh concrete is provided only through the joint pin located closer to the separating plane.

In the case of the kinematic chain for pivoting the boom arms relative to one another, the hydraulic cylinder is preferably arranged on the first boom arm. Particularly in cases in which the coupling bars of the kinematic chain engage a projection arranged on the second boom arm, the joint kinematics may be configured to act exclusively perpendicular to the pivot axis. In this way, lateral bending loads on the kinematic chain for pivoting the boom arms can be kept small.

If the joint comprises two pivot pins arranged axially along the pivot axis, lateral bending loads on the kinematic chain can be reduced further still if a coupling rod directly connected to the other (so preferably to the second) boom arm or to the projection arranged on the second boom arm is arranged between the two joint pins.

In this case, it is preferable for the concrete delivery line of one (preferably the first) boom arm to run in the region of the kinematic chain between the hydraulic cylinder and the separating plane. It is thereby ensured that the concrete delivery line cannot crash into the hydraulic cylinder, as a result of which the pivoting range of the joint could be limited or coupling rods not optimally adapted to force transmission in terms of their shape could be necessary.

The at least one hollow joint pin preferably has a free internal diameter of 80 to 200 mm. A corresponding internal diameter is sufficient for the conveyance of fresh concrete or the implementation of a delivery line section configured for this purpose.

It is preferable for an exchangeable delivery line section to be arranged in the at least one hollow joint pin. Because the fresh concrete is not conducted directly along the inner wall of the hollow joint pin, wearing of the joint pin, which would require an expensive replacement, can be avoided. Instead, the delivery line section running in the joint pin can be replaced where necessary. The delivery line section in this case is preferably rotatably coupled to the delivery lines of the boom arms.

The joint preferably has a maximum pivot angle—in other words, the angle between the two end positions of the joint—of more than 150°, more advantageously of more than 175°.

If the distribution boom comprises more than two boom arms, the distribution boom is preferably configured as an articulated arm boom. All boom arms of the distribution boom are then connected to one another via joints in each case, so that two adjacent boom arms can be pivoted about a common pivot axis relative to one another.

In order to explain the concrete pump according to the invention, reference is made to the foregoing comments.

BRIEF DESCRIPTION OF THE DRAWINGS

The invention is described by way of example with the help of advantageous embodiments with reference to the attached drawings. In the drawings:

In FIGS. 1*a*-1*c*, a mobile concrete pump 1 with a distribution boom 2 is depicted schematically in plan view (FIG. 1*b*) and the two associated side views (FIGS. 1*a*, 1*c*).

DETAILED DESCRIPTION

Figure 1A:
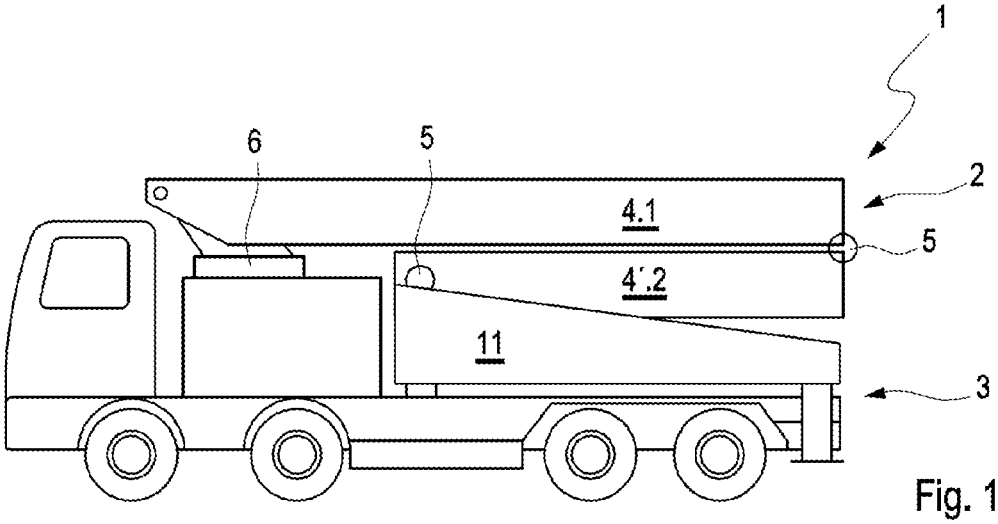
FIGS. 1*a*-1*c* show a schematic representation of a mobile concrete pump with a distribution boom according to the invention in two side views (a, c) and a plan view (b)

The mobile concrete pump 1 is an automatic concrete pump in which the distribution boom 2 is rotatably fastened to a movable base 3. The distribution boom 2 can be opened out and for this purpose it comprises multiple boom arms 4 that can be pivoted relative to one another about joints 5. A concrete delivery line is provided along the boom arms 4 through which fresh concrete can be conveyed with the help of a concrete pump arranged in the base 3. To provide a better overview, only the load-bearing structure of the boom arms 4 is depicted in FIGS. 1 and 2.

Figure 1B:
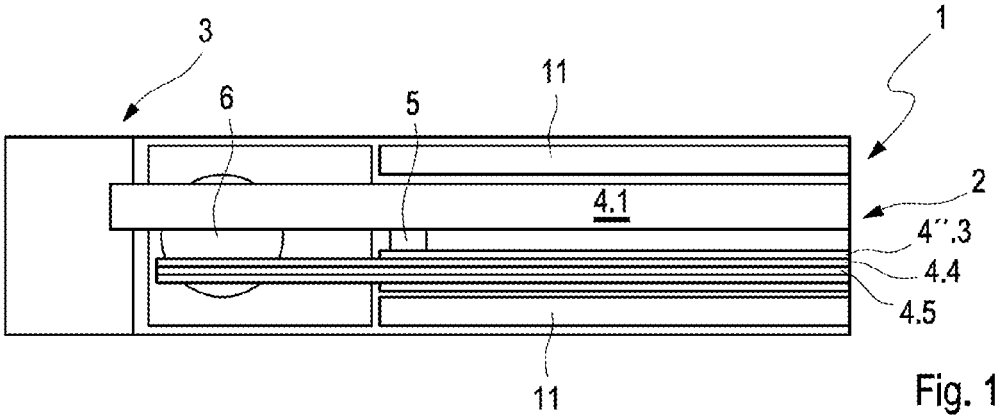
Figure 1C:
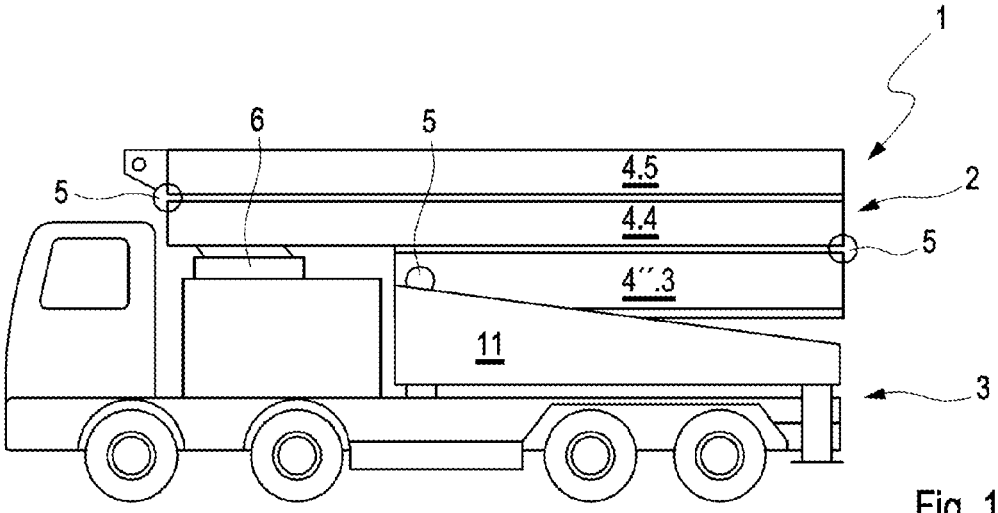

The distribution boom 2 comprises a total of five boom arms 4.1, 4'.2, 4".3, 4.4, 4.5 which can be folded together in an RZ fold—as shown in FIG. 1—wherein the lowermost boom arm 4.1 is pivotably fastened to the rotating head 6. In the case of the distribution boom 2 according to the invention, the load-bearing structures of the two lower boom arms 4.1, 4'.2 are completely adjacent to the load-bearing structures of the two upper boom arms 4".3, 4.4, 4.5 (see FIG. 1*b*), wherein, according to their sequence, adjacent boom arms 4 are each pivotably connected to one another via a joint 5, in other words the boom arm 4.1 to the boom arm 4'.2, 4'.2 to 4".3, etc. In the folded state, the boom arms 4 lie between the pivot legs 11 which, along with the support legs, which are not shown, in the front region of the base 3 ensure greater tilting stability of the mobile concrete pump 1 when the distribution boom 2 is being opened out.

Figure 2C:
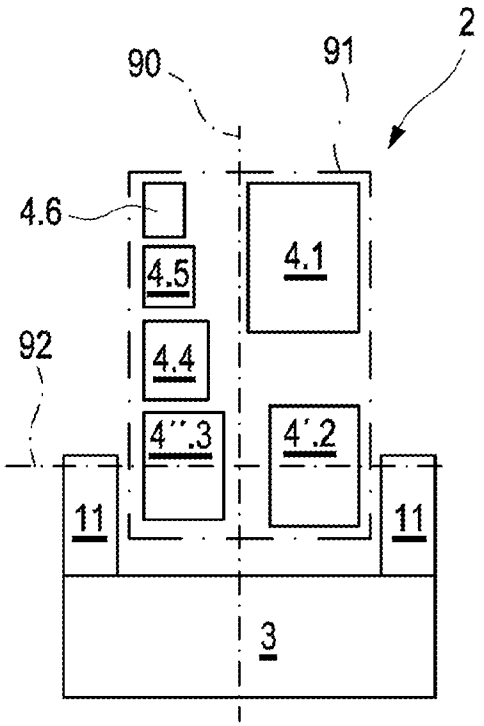
FIG. 2*c* shows a schematic sectional view through a variant of the concrete pump from FIG. 1.
Figure 2B:
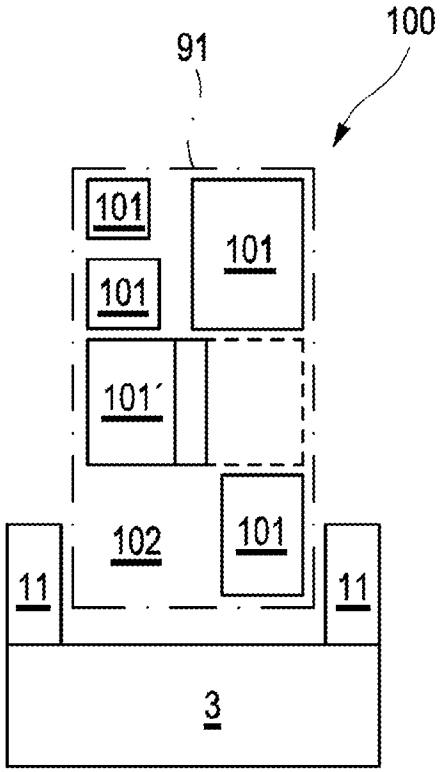
Fig. 2 b (Prior art)
FIG. 2*b* shows a schematic sectional view through a concrete pump according to the prior art.
Figure 2A:
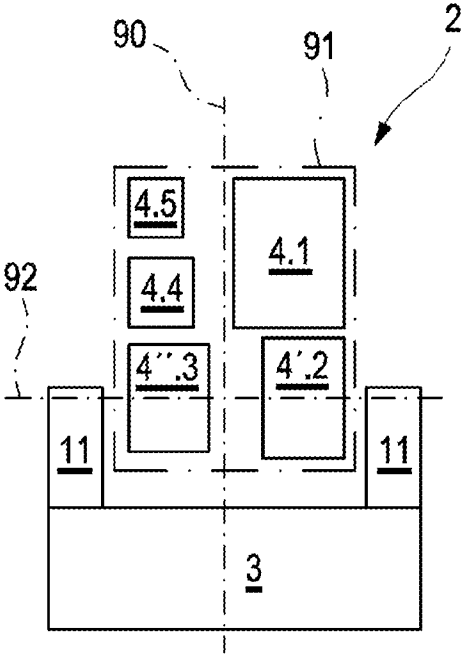
FIG. 2*a* shows a schematic sectional view through the concrete pump according to FIG. 1.

The position of the load-bearing structure of each of the individual boom arms 4 in the folded state is also made clear in FIG. 2*a* which shows a schematic sectional view through the concrete pump 1 according to FIG. 1. Between the load-bearing structure of the boom arms 4.1 and 4'.2 on one side and the load-bearing structure of the boom arms 4".3, 4.4 and 4.5 on the other side runs a separating plane 90 which is not intersected by any load-bearing structure of the boom arms 4 and, in particular, not by the load-bearing structure of the boom arms 4'.2 and 4".3.

The box-shaped installation space which is used by the boom arms 4 of the boom arm 2 according to the invention in the folded state is indicated in FIG. 2*a* by the dotted line 91.

In order to compare the installation space 91 required by a distribution boom 2 according to the invention, the installation space 91 of a boom 100 according to the prior art is shown in FIG. 2*b*. For ease of comparison, the boom 100 likewise has five boom arms 101 which must be assumed to have identical lengths to the boom arms 4, so that the boom 100 can in principle reach the same maximum height as the distribution boom depicted in FIGS. 1 and 2*a*.

In the case of the boom 100 according to the prior art, the middle boom arm 101' is cranked so that when it is in the folded state, the two outer boom arms 101 come to lie in a plane alongside the two lower boom arms 101. Due to the cranking of the middle boom arm 101' provided for in the prior art, a comparatively large installation space 91 is, however, required on account of the not inconsiderable unused regions 102 within the installation space.

As immediately shown by a comparison between FIGS. 2*a* and 2*b*, a substantial amount of installation space 91 can be saved by a distribution boom 2 according to the invention. This installation space saving then also provides the opportunity for additional boom arms 4 to be provided where necessary, without the installation space 91 being enlarged in an unacceptable manner—particularly with regard to the total height of the concrete pump 1. A corresponding example is depicted in FIG. 2*c* in which an additional sixth boom arm 4.6 is provided by comparison with the exemplary embodiment according to FIG. 2*a* or the prior art according to FIG. 2*b*. Even though the total installation space 91 required may be larger compared with the exemplary embodiment from FIGS. 1 and 2*a* on account of the additional boom arm 4.6, the necessary installation space 91 is nevertheless smaller by comparison with a boom 100 according to the prior art with only five boom arms 101.

In order to achieve the smaller installation space requirement compared with the prior art, it is provided according to the invention that the load-bearing structures of two adjacent boom arms—that of the boom arms 4'.2 and 4".3 in the exemplary embodiment shown—are connected to one another via a joint in such a manner that a separating plane 90 may be found between them which runs perpendicular to the common pivot axis 92 and which is not intersected by the load-bearing structure of the two boom arms 4'.2 and 4".3 in each case. It is advantageous but not strictly necessary that none of the other boom arms 4.1, 4.4, 4.5 and possibly 4.6 intersects the separating plane 90 (cf. FIGS. 2*a* and 2*c*).

Figure 3A:
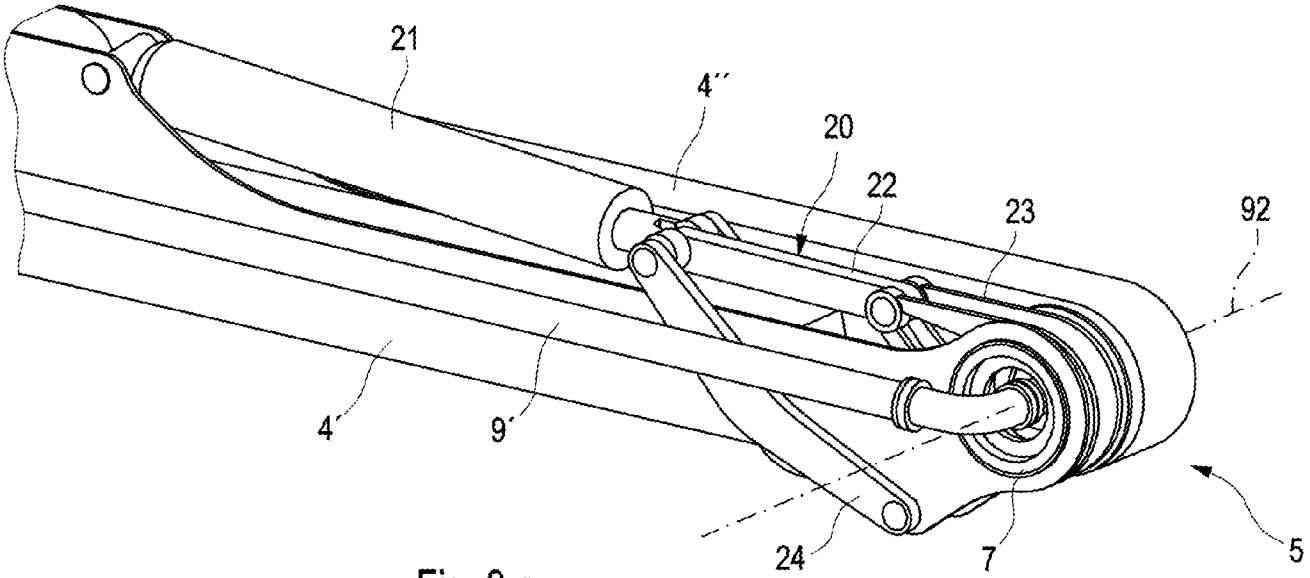
FIGS. 3*a*-3*c* show a first exemplary embodiment of a joint for the distribution boom in accordance with FIG. 1.
Figure 3B:
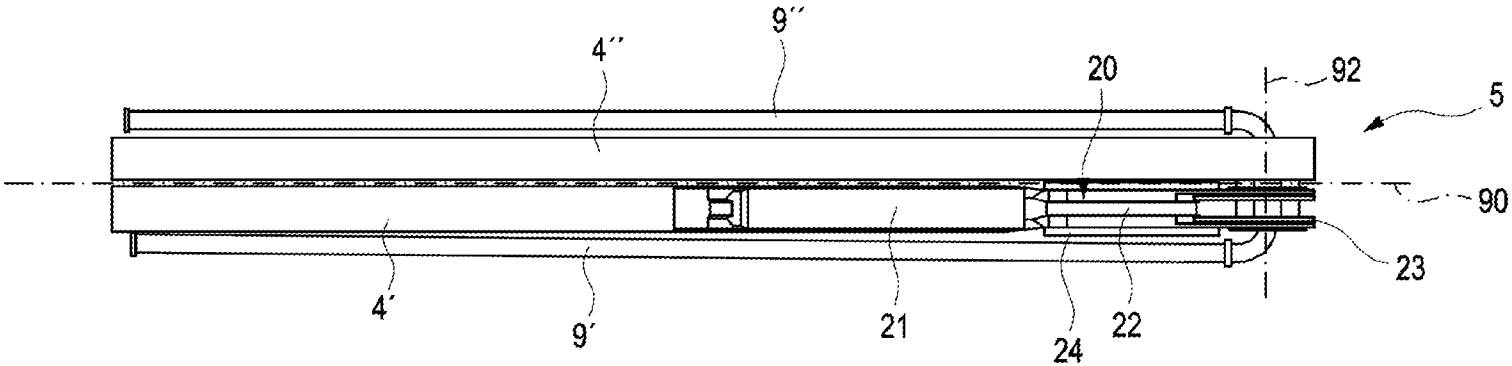
Figure 4A:
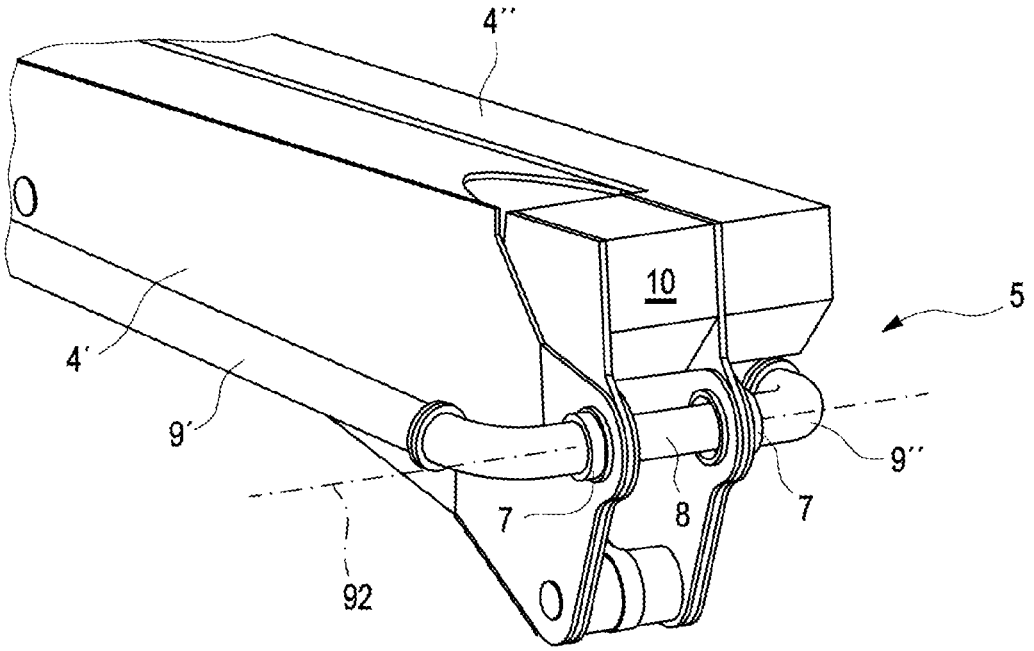
FIGS. 4*a*-4*d* show a second exemplary embodiment of a joint for the distribution boom in accordance with FIG. 1.
Figure 4B:
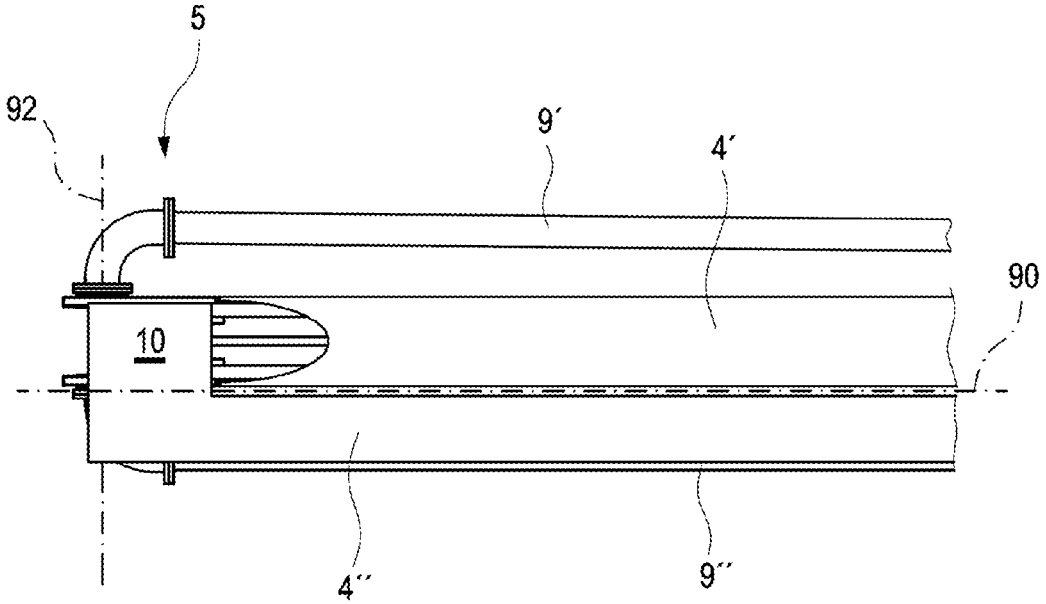
Figure 4C:
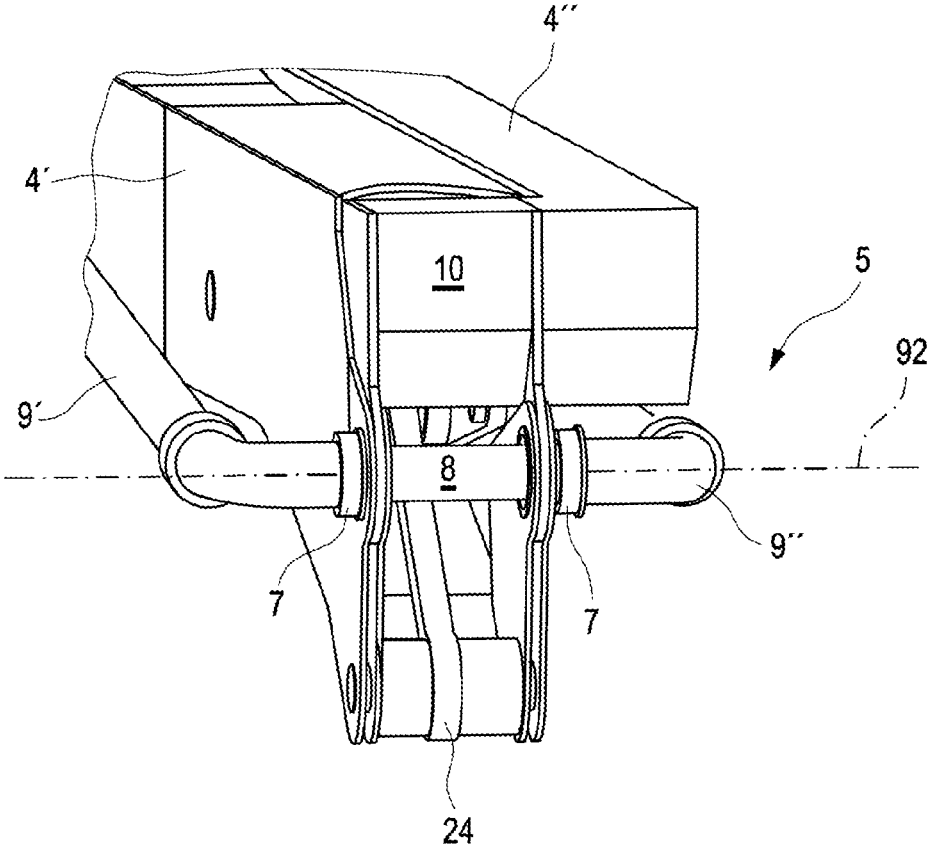
Figure 4D:
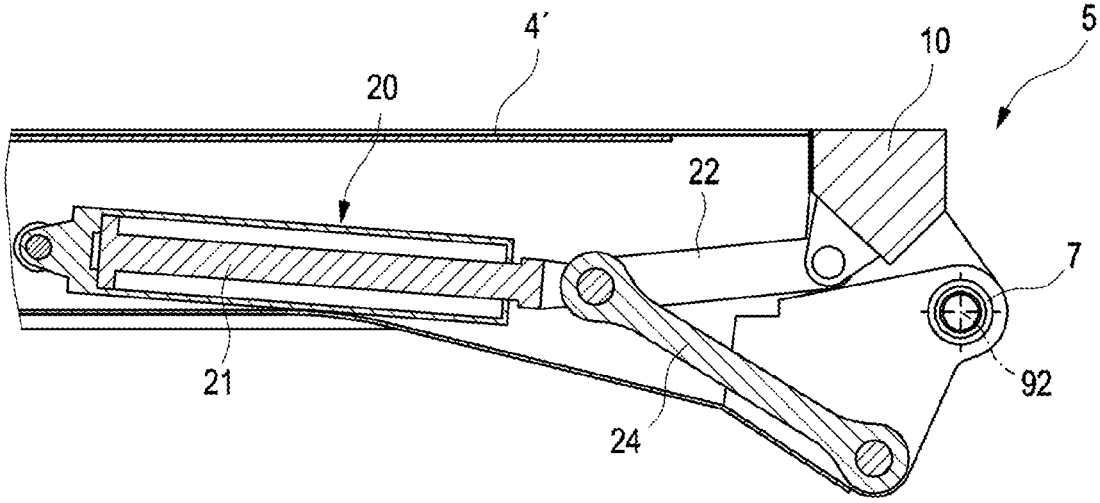
Figure 5A:
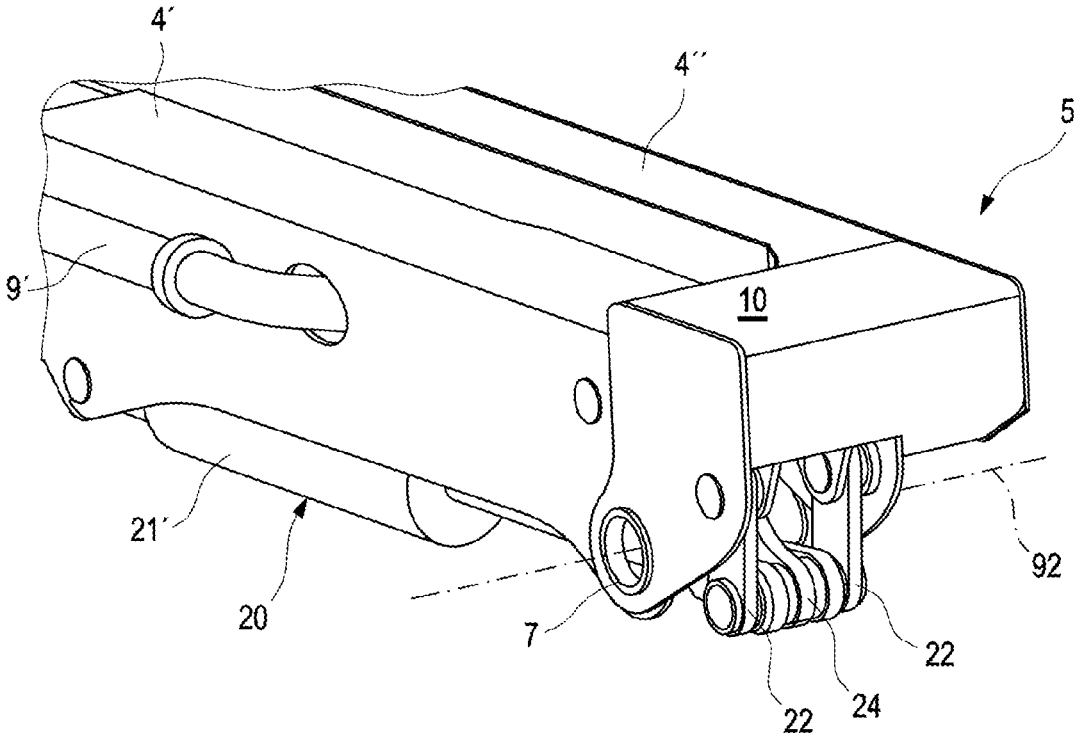
FIGS. 5*a*-5*c* show a third exemplary embodiment of a joint for the distribution boom in accordance with FIG. 1.
Figure 5B:
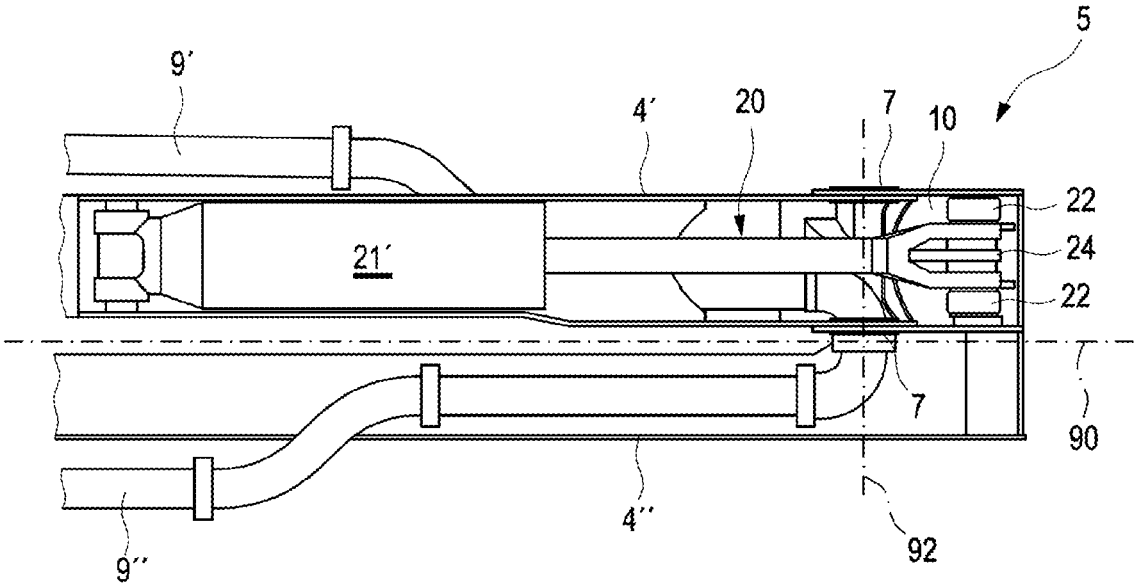
Figure 5C:
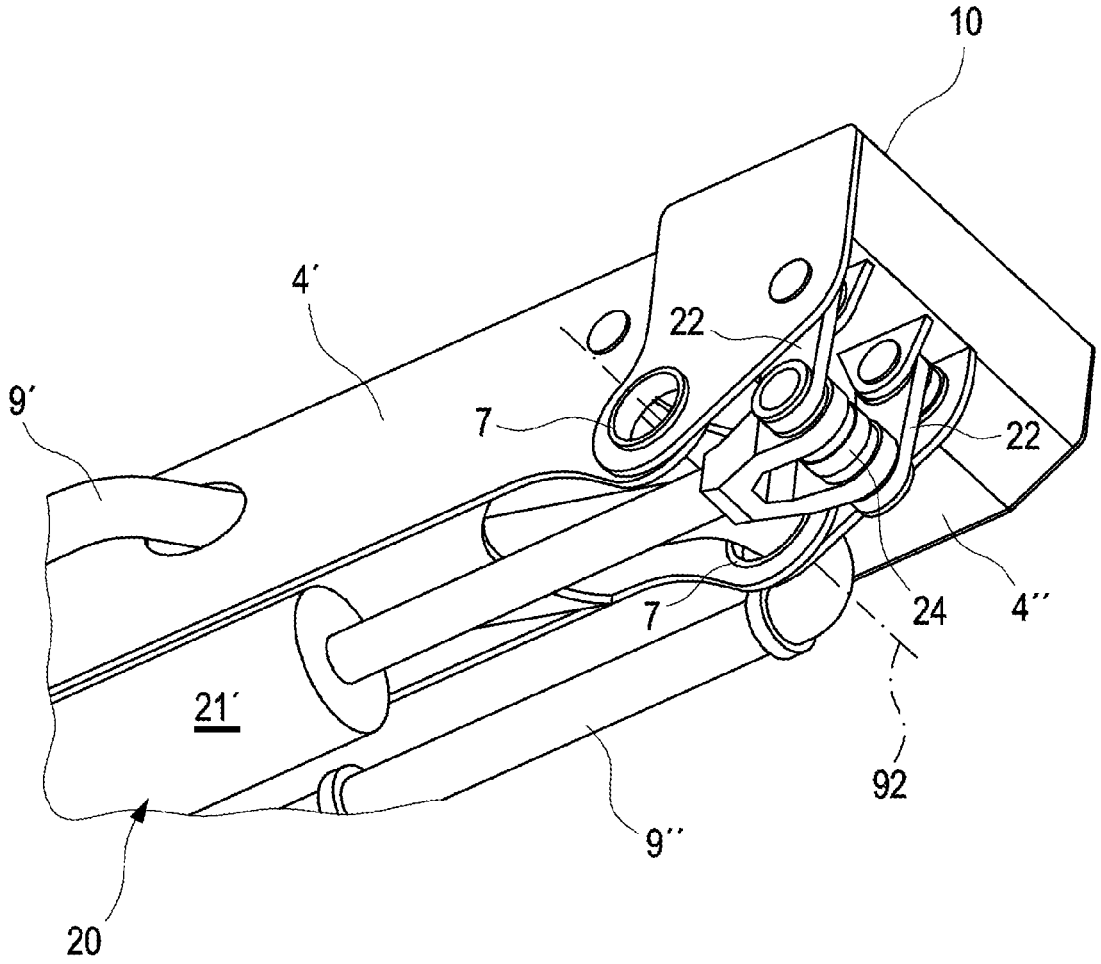

Different variants of joints 5 are depicted in FIGS. 3 to 5, showing how the boom arms 4'.2 and 4".3 are pivotably connected to one another, so that the aforementioned requirements are met. In the following, the boom arm 4'.2 is also generally referred to as the first boom arm 4' and the boom arm 4".3 as the second boom arm 4", in order to illustrate that the joints 4 which are shown need not or cannot necessarily be arranged (only) between the boom arms 4'.2, 4".3.

Figure 3C:
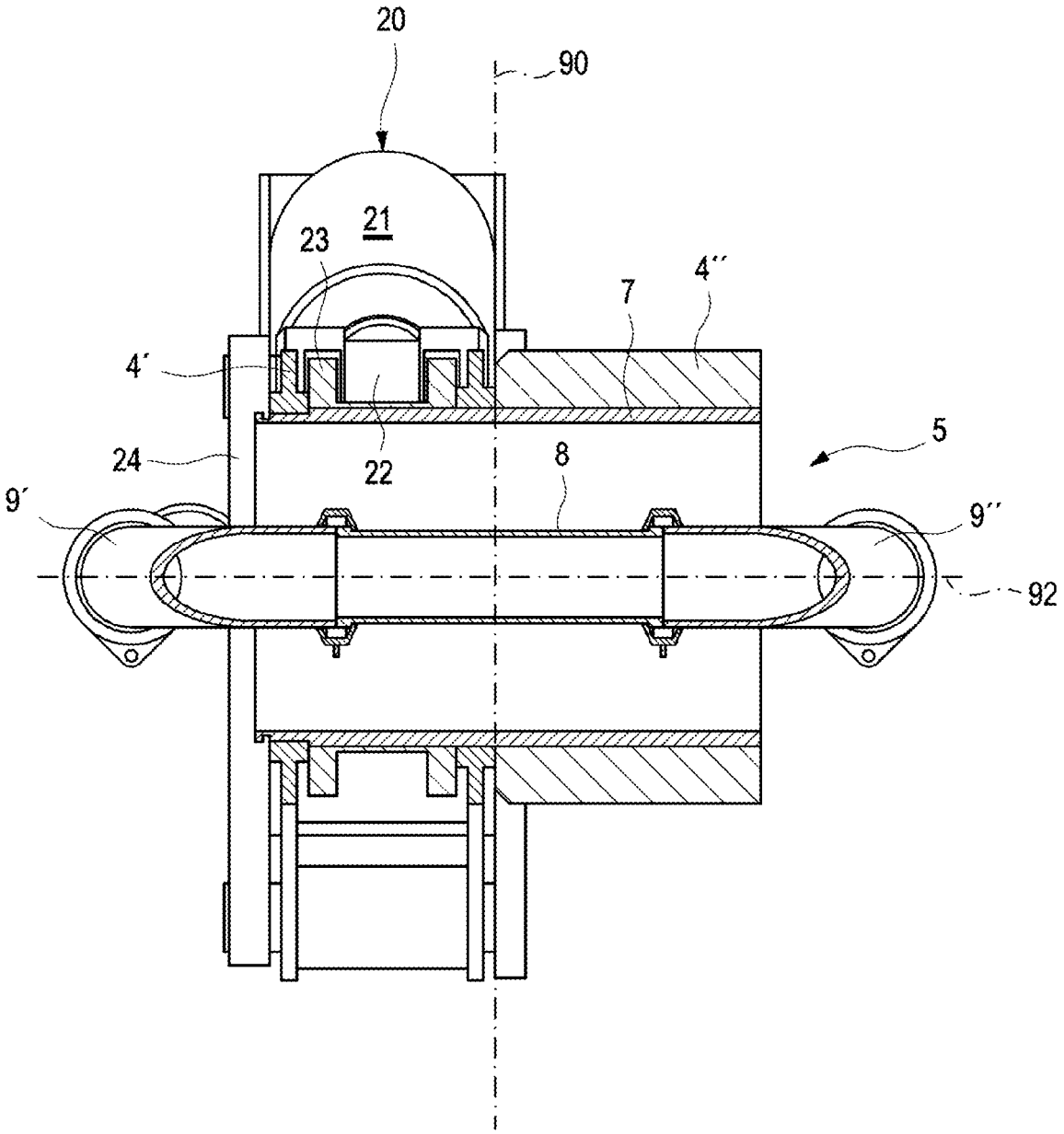

In the case of the joint variant according to FIG. 3, the two boom arms 4 and, in particular, the load-bearing structures of each of these run parallel to the separating plane 90 and do not intersect it. A joint pin 7 running axially to the pivot axis 92 via which the two boom arms 4 are pivotably connected to one another is arranged in the region of the joint 5. The joint pin 7 in this case extends through both boom arms (cf. sectional view in FIG. 3*c*) and is rotatably mounted in the first boom arm 4', while it is non-rotatable in respect of the second boom arm 4".

For the pivoting movement, a kinematic chain 20 comprising a hydraulic pressure cylinder 21, coupling rod 22, articulated lever 23 and guide rod 24 is provided. The articulated lever 23 is fastened to the joint pin 7 in a non-rotatable manner, so that a pivoting movement of the articulated lever 23 in respect of the first boom arm 4' results in a pivoting movement of the second boom arm 4". By means of the pressure cylinder 21, force can be applied to the articulated lever 23 via the coupling rod 22 guided by the guide rod 24, so that the desired pivoting movement is achieved.

The joint pin 7 has a hollow design with an internal diameter of 150 mm for the conveyance of fresh concrete, wherein an exchangeable delivery line section 8 is arranged through the joint pin 7 via which a concrete delivery line 9' on the first boom arm 4' is connected to a concrete delivery line 9" on the second boom arm 4". The delivery line section 8 in this case is rotatably fastened in respect of the concrete delivery lines 9', 9".

The joint variant in FIG. 4 comprises a projection 10 arranged on the second boom arm 4", which projection 10 protrudes beyond the first boom arm 4' in the region of the joint 5. Away from the joint 5, the separating plane 90 is furthermore not intersected by the two boom arms 4', 4" and, in particular, by the load-bearing structures thereof.

The two boom arms 4', 4" are pivotably connected to one another via the projection 10 by two joint pins 7 about the pivot axis 92. The two joint pins 7 are hollow in this case, so that an exchangeable delivery line section 8 for connecting the concrete delivery lines 9', 9" on both boom arms 4', 4" can be guided through both joint pins.

The kinematic chain 20 for the pivoting movement of the two boom arms 4', 4" relative to one another is arranged within the first boom arm 4' and comprises—as can be seen in particular in the sectional view in FIG. 4*d*—a hydraulic pressure cylinder 21, coupling rod 22 and guide rod 24. The pressure cylinder 21 and guide rod 24 are rotatably fastened to the first boom arm 4', while the coupling rod 22 engages the projection 10. Force can be applied to the projection 10 by the pressure cylinder 21 via the coupling rod 22 guided by the guide rod 24, in order to bring about a pivoting movement of the second boom arm 4" in respect of the first boom arm 4'.

In the case of the joint variant according to FIG. 5, similarly to the case of the variant according to FIG. 4, a projection 10 is provided on the second boom arm 4" which protrudes beyond the other boom arm 4' in the region of the joint 5, wherein away from the joint 5 the boom arms 4', 4", or else the load-bearing structures thereof, are completely separated by the separating plane 90 and do not therefore intersect it.

The projection 10 and therefore the second boom arm 4" are pivotably mounted in respect of the first boom arm 4' via two hollow pivot pins 7 arranged along the pivot axis 92.

The kinematic chain 20 is completely arranged in the region of the first boom arm 4' and the projection 10 and comprises, in addition to two parallel-running coupling rods 22 and a guide rod 24, a hydraulic traction cylinder 21'. The traction cylinder 21' is connected via the two coupling rods 22 to the projection 10, wherein the connection point between the traction cylinder 21' and coupling rods 22 is conducted through the guide rod 24.

Even if both joint pins 7 are hollow in this exemplary embodiment, the concrete delivery line 9' of the first boom arm 4' is placed in the region of the joint 5 and, in particular, of the kinematic chain 20 between the hydraulic cylinder 21' and the separating plane 90, so that the delivery line section 8 for the conveyance of fresh concrete is only guided through the joint pin 7 arranged closer to the separating plane 90. It is thereby ensured that the concrete delivery line 9' does not obstruct the hydraulic traction cylinder 21' or the kinematic chain 20.

It is also possible, of course, for the joint variant according to FIG. 5 to be alternatively configured with a hydraulic pressure cylinder and kinematic chain 20 adapted thereto.

All exemplary embodiments and joint variants shown have a maximum pivot angle of 180°.

The invention claimed is:

1. A distribution boom (2) for a concrete pump (1) comprising at least a first and a second boom arm (4', 4"), wherein the first and the second boom arm (4', 4") are connected to one another via a joint (5) and are pivotable relative to one another via the joint (5) about a pivot axis (92), and wherein a concrete delivery line (9', 9") is provided along the boom arms (4', 4"), wherein the joint (5) connects the first and the second boom arm (4', 4") in a manner offset to one another in the direction of the pivot axis (92) in such a manner that the load-bearing structures, configured as hollow profiles, of each of the two boom arms (4', 4") intersect a separating plane (90) running perpendicular to the pivot axis (92) between the first and the second boom arm (4', 4") only in the joint (5), wherein the joint (5) comprises a lateral projection (10) which is arranged on the second boom arm (4") and protrudes beyond the first boom arm (4'), and the two boom arms (4', 4") are pivotably connected to one another via the lateral projection (10) of the joint (5), and wherein a hydraulic cylinder (21, 21') is arranged on the first boom arm (4'), said hydraulic cylinder acting on the lateral projection (10) arranged on the second boom arm (4") via one or more coupling rods (22) in such a manner that the joint kinematics act exclusively perpendicular to the pivot axis (92) of the joint (5) and that a pivoting movement of the two boom arms (4', 4") relative to one another can be effected by the hydraulic cylinder (21, 21') about the pivot axis (92) of the joint (5).

2. The distribution boom of claim 1, wherein the joint (5) has at least one hollow joint pin (7) coaxial to the pivot axis (92) for carrying fresh concrete from a concrete delivery line (9') on the first boom arm (4') to a concrete delivery line (9") on the second boom arm (4").

3. The distribution boom of claim 2, wherein the at least one hollow joint pin (7) has a free internal diameter of 80 to 200 mm.

4. The distribution boom of claim 2, wherein an exchangeable delivery line section (8) is arranged in the at least one, hollow joint pin (7).

5. The distribution boom of claim 1, wherein the joint (5) comprises two joint pins (7) arranged axially along the pivot axis (92) of which at least the joint pin (7) located closer to the separating plane (90) is a hollow joint pin (7), wherein a conveyance of fresh concrete is provided only through the joint pin (7) located closer to the separating plane (90).

6. The distribution boom of claim 1, wherein a coupling rod (22) directly connected to the other boom arm (4") is arranged between two joint pins (7) arranged on the pivot axis (92).

7. The distribution boom of claim 6, wherein the concrete delivery line (9') of one boom arm (4') runs between the hydraulic cylinder (21, 21') and the separating plane (90).

8. The distribution boom of claim 1, wherein the concrete delivery line (9') of one boom arm (4') runs between the hydraulic cylinder (21, 21') and the separating plane (90).

9. The distribution boom of claim 1, wherein the joint (5) has a maximum pivot angle of more than 150°.

10. The distribution boom of claim 1, wherein the distribution boom (2) comprises more than two boom arms (4), wherein the distribution boom (2) is configured as an articulated arm boom.

11. A mobile concrete pump (1) having a distribution boom (2), wherein the distribution boom (2) is configured according to claim 1.

* * * * *